US010176739B2

(12) United States Patent
Singh et al.

(10) Patent No.: US 10,176,739 B2
(45) Date of Patent: Jan. 8, 2019

(54) PARTIAL REFRESH OF DISPLAY DEVICES

(71) Applicant: Nvidia Corporation, Santa Clara, CA (US)

(72) Inventors: Gaurav Singh, Pune (IN); Radhika Ranjan Soni, Pune (IN)

(73) Assignee: Nvidia Corporation, Santa Clara, CA (US)

( * ) Notice: Subject to any disclaimer, the term of this patent is extended or adjusted under 35 U.S.C. 154(b) by 0 days.

(21) Appl. No.: 14/918,449

(22) Filed: Oct. 20, 2015

(65) Prior Publication Data

US 2017/0109859 A1 Apr. 20, 2017

(51) Int. Cl.
*G09G 5/36* (2006.01)
*G09G 3/20* (2006.01)

(52) U.S. Cl.
CPC ..... *G09G 3/20* (2013.01); *G09G 2310/04* (2013.01); *G09G 2320/103* (2013.01); *G09G 2370/04* (2013.01)

(58) Field of Classification Search
CPC ..... G09G 2310/04; G09G 2330/021; G09G 2340/16; G09G 2360/18; G09G 2320/103; G06F 1/3265; G06F 3/1415; G06F 3/1462; H04N 7/0127
See application file for complete search history.

(56) References Cited

U.S. PATENT DOCUMENTS 8,704,839 B2 * 4/2014 Kobayashi ..... G09G 5/003 345/531
2002/0140685 A1 * 10/2002 Yamamoto ..... G09G 3/20 345/204
2008/0100641 A1 * 5/2008 Frederick ..... G06F 3/14 345/619
2012/0079295 A1 * 3/2012 Hayek ..... G06F 1/3218 713/310
2014/0104243 A1 * 4/2014 Sakariya ..... G06F 3/14 345/204
2014/0118377 A1 * 5/2014 Bae ..... G09G 5/005 345/545

* cited by examiner

*Primary Examiner* — Hau H Nguyen

(57) ABSTRACT

An aspect of the present invention proposes a method for performing partial refresh on display panels. According to one or more embodiments of the present invention, the display panels may be implemented as self-refreshing display panels communicatively coupled with a computing device that generates graphical data for display in the display panel. To perform partial refresh, consecutive frames are compared to identify the portions of the frames with updated material. In one or more embodiments, only the pixels corresponding to the updated portion(s) are refreshed in the display panel.

23 Claims, 6 Drawing Sheets

Current Frame 200b

Previous Frame 200a

300

500

Exemplary Computer
System 600

PARTIAL REFRESH OF DISPLAY DEVICES

TECHNICAL FIELD

The embodiments of the present application are directed to methods and systems for refreshing display devices. In particular, the present application is directed to performing partial refresh of display devices.

BACKGROUND OF THE INVENTION

The prevailing design methodology goals of displays that accompany computing devices (such as smart phones, tablets devices, netbooks, personal data assistants, portable media devices, wearable devices, and even laptops and personal computers) are to achieve slimmer profiles while providing larger display sizes.

For modern display devices such as liquid crystal displays (LCD) or light emitting diode (LED) displays, the display panels are typically implemented as two dimensional pixel arrays, which may be charged (thereby emitting light) in positions and ordered based on the graphical output generated for display.

Conventional display devices are commonly equipped with local storage capabilities, to temporarily pre-load multiple frames of graphical data prior to display. The frames may be presented at a pre-determined (or dynamic) frame rate, often represented as framerate per second (FPS). Similarly, the refresh rate of a display device designates the number of times the graphical data is rendered (drawn) on the display device. Typically, the refresh rate is equal to or higher than the frame rate, such that the same frame may be redrawn one or more times per generation. However, conventional approaches (for LCD devices in particular) of refreshing display panels perform refreshing at pre-determined time intervals, based on the device's capabilities (as specified by the manufacturer), or by an application. This refresh rate is constant even if every pixel in the frame does not change with respect to the previous frame.

Generally, the largest power consuming component in mobile devices with sophisticated graphical and display capabilities is the display panel, which can approach half or more of the device's total power consumption single-handedly. Maintaining a constant refresh rate, and refreshing the entirety of a display panel despite minimal or no pixel changes contribute to the issue by creating inefficient and unnecessary power consumption.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

An aspect of the present invention proposes a method for performing partial refresh on display panels. According to one or more embodiments of the present invention, the display panels may be implemented as self-refreshing display panels communicatively coupled with a computing device that generates graphical data for display in the display panel. To perform partial refresh, consecutive frames are compared to identify the portions of the frames with updated material. In one or more embodiments, only the pixels corresponding to the updated portion(s) are refreshed in the display panel.

According to one or more further embodiments, the display panels may operate according to (user-controlled) settings within manufacturer specified limits, as provided in an Extended Display Identification Data (EDID) structure. The settings may include, for example, a maximum hold time, which specifies the maximum length of time a pixel in the display panel may operate without being refreshed. According to such embodiments, pixels that have not been refreshed for a duration of time that meet, exceed, or approach the maximum hold time may also be refreshed along with the update portion during a refresh cycle. The remaining pixels in the display panel may be maintained (unmodified) without being refreshed.

According to one or more embodiments, the timing controller that determines which pixels need to be refreshed is able to enter a low power state immediately after the determination. Since the number of pixels that are refreshed during each cycle are relatively less than full-refreshing display panels, the timing controller is able to advantageously achieve a slight reduction in power consumption while in a low power state for each refresh cycle.

According to various aspects of the present invention, the comparison between consecutive frames may be performed in either the processor generating the output (e.g., a graphical processing unit) or in the display panel itself. In one or more embodiments, instructions for generating graphical output received by the processor for a current frame is compared to instructions for generating graphical output from the immediately previous frame. Only the updated portion is then sent to the display panel. Alternately, an entire composed frame including the updated portion may be sent from the processor to the display panel. Within the display panel, the frame is compared to the previous frame in the memory of the display panel to determine the updated portion. Regardless of which aspect is implemented, the pixels in the display panel corresponding to the updated portion are refreshed during the next refresh cycle.

Another aspect of the present invention comprises a computing system with a self-refreshing display panel that collectively performs one or more of the partial refresh processes described above. According to one or more embodiments, a computing system with a processor configured to generate graphical output generates a sequence of graphical frames to be displayed in an attached or otherwise communicatively coupled display device. Consecutive frames are compared (either prior to generation or within the memory of the display device) to determine an updated portion, and the pixels corresponding to the updated portion are refreshed in the display device at the next refresh cycle. In one or more further embodiments, pixels that have not been refreshed for a duration of time that meets, exceeds, or approaches a threshold may also be refreshed at this time, while the remaining portion of the display panel (which can be a vast majority of the pixels) remains unrefreshed.

BRIEF DESCRIPTION OF THE DRAWINGS

The accompanying drawings are incorporated in and form a part of this specification. The drawings illustrate embodiments. Together with the description, the drawings serve to explain the principles of the embodiments.

DETAILED DESCRIPTION

Figure 1:
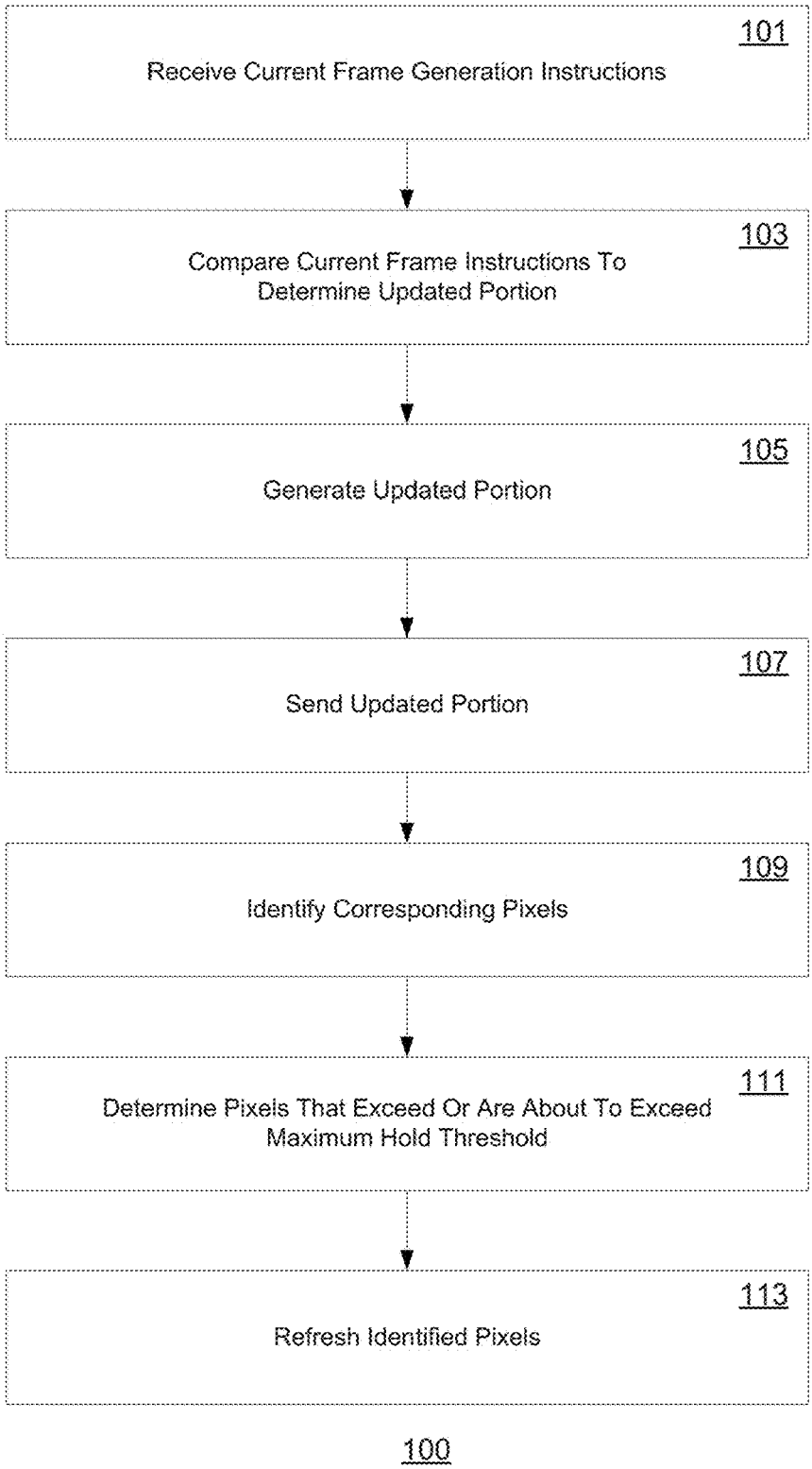
FIG. 1 depicts a flowchart of an exemplary computer-controlled process for performing partial frame updating in a computing device, in accordance with various embodiments of the present invention.

Reference will now be made in detail to the preferred embodiments of the claimed subject matter, a method and system for the use of a computing system, examples of which are illustrated in the accompanying drawings. While the claimed subject matter will be described in conjunction with the preferred embodiments, it will be understood that they are not intended to limit these embodiments. On the contrary, the claimed subject matter is intended to cover alternatives, modifications and equivalents, which may be included within the spirit and scope as defined by the appended claims.

Furthermore, in the following detailed descriptions of embodiments of the claimed subject matter, numerous specific details are set forth in order to provide a thorough understanding of the claimed subject matter. However, it will be recognized by one of ordinary skill in the art that the claimed subject matter may be practiced without these specific details. In other instances, well known methods, procedures, components, and circuits have not been described in detail as not to obscure unnecessarily aspects of the claimed subject matter.

Some portions of the detailed descriptions which follow are presented in terms of procedures, steps, logic blocks, processing, and other symbolic representations of operations on data bits that can be performed on computer memory. These descriptions and representations are the means used by those skilled in the data processing arts to most effectively convey the substance of their work to others skilled in the art. A procedure, computer generated step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present claimed subject matter, discussions utilizing terms such as "storing," "creating," "protecting," "receiving," "encrypting," "decrypting," "destroying," or the like, refer to the action and processes of a computer system or integrated circuit, or similar electronic computing device, including an embedded system, that manipulates and transforms data represented as physical (electronic) quantities within the computer system's registers and memories into other data similarly represented as physical quantities within the computer system memories or registers or other such information storage, transmission or display devices.

Partial Refresh

Embodiments of the claimed subject matter are presented to provide a novel system and method for performing partial refresh of display panels and other display devices, such as liquid crystal display (LCD) screens of mobile devices, monitors, televisions, or other computing devices including, but not limited to, laptops, netbooks, video game consoles, personal wearable devices, personal data assistants, personal computer, etc. According to one or more embodiments, the display panels may be implemented as self-refreshing display panels, such that the timing of the refresh operation is performed locally, rather than driven by a communicatively attached processor or other non-local timing circuit. In still further embodiments, the display panel may be equipped with storage capability, such as graphical random access memory (GRAM), and may be implemented as two-dimensional array of programmable pixels.

FIG. 1 is a flowchart 100 of an exemplary process for performing partial updating in a computing device. Steps 101 to 113 describe the steps comprising the process depicted in the flowchart 100 of FIG. 1. As depicted in FIG. 1, instructions for generating a graphical frame are received in step 101. In one or more embodiments, the instructions may be issued by an application executing in the computing device, and may be received in a processor, such as a graphics processing unit (GPU), application processor (AP), central processing unit (CPU), or any other microprocessor configured to produce graphical content. The instructions may correspond to a current frame of a sequence or plurality of frames being displayed in an attached (or communicatively coupled) display panel.

At step 103, the instructions to generate the current frame are compared to instructions to generate the frame immediately preceding the current frame to determine the portion that has been modified (updated) since the immediately preceding frame. The updated portion is generated by the processor at 105, and sent to the display panel at step 107. In one or more embodiments, the updated portion is received in a memory in the display panel. In still further embodiments, the memory in the display panel may comprise volatile memory, such as a graphical random access memory (GRAM) implemented as a frame buffer.

At step 109, the pixels in the display panel that correspond to the updated portion of the frame are identified. In one or more embodiments, the graphical data generated by the processor is produced to conform to the size (i.e., resolution) of the display panel. Where an updated portion is determined to be present, the location(s) of the pixels in the display panel—represented by coordinates, for example—corresponding to the updated portion in the frame is (are) identified.

In one or more embodiments, the pixels in the display panel have a maximum duration of time after which the light emitted by the pixel fades and the pixel needs to be refreshed. This duration (i.e., the maximum hold time) for the pixels may be specified in the display panel's EDID, and may be specified by the manufacturer. At step 111, all other pixels in the display panel that were not determined at step 109 to be among the pixels corresponding to the updated portion are scanned to determine if the duration since any of the pixels were last refreshed exceeds or approaches the maximum hold time. According to one or more further embodiments, pixels with a duration since a last refresh that approach the maximum hold time may include pixels that do not need to be refreshed for the current refresh cycle, but will fade and/or otherwise need to be refreshed by the next refresh cycle. In one or more embodiments, step 111 may be performed by referencing a timing controller (TCON) of the display panel to determine the last refresh times for each of the remaining pixels. In still further embodiments, when the last refresh time for a pixel approaches the maximum hold time (e.g., meets or exceeds a threshold close to the maximum hold time), the pixel may be marked to be refreshed.

Finally, at step 113, the pixels corresponding to the updated portion of the frame determined in step 109, and the pixels determined at step 111 to have a last refresh time that meets or exceeds a threshold based on the maximum hold time are refreshed by the display panel. The remaining pixels are maintained without modification, until at least the next refresh cycle.

Figure 2B:
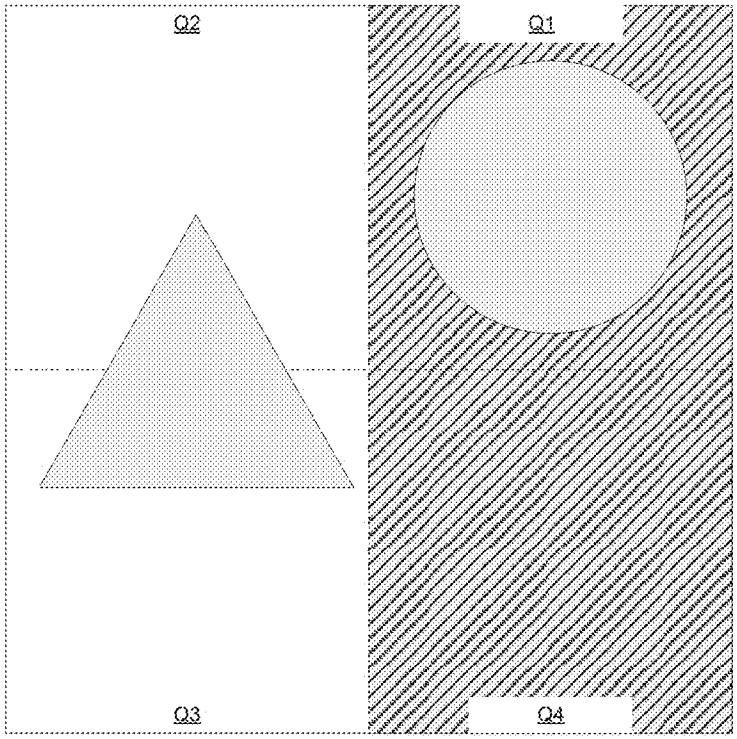
FIG. 2*b* depicts a diagram of a second exemplary frame with partial refresh, in accordance with various embodiments of the present invention.
Figure 2A:
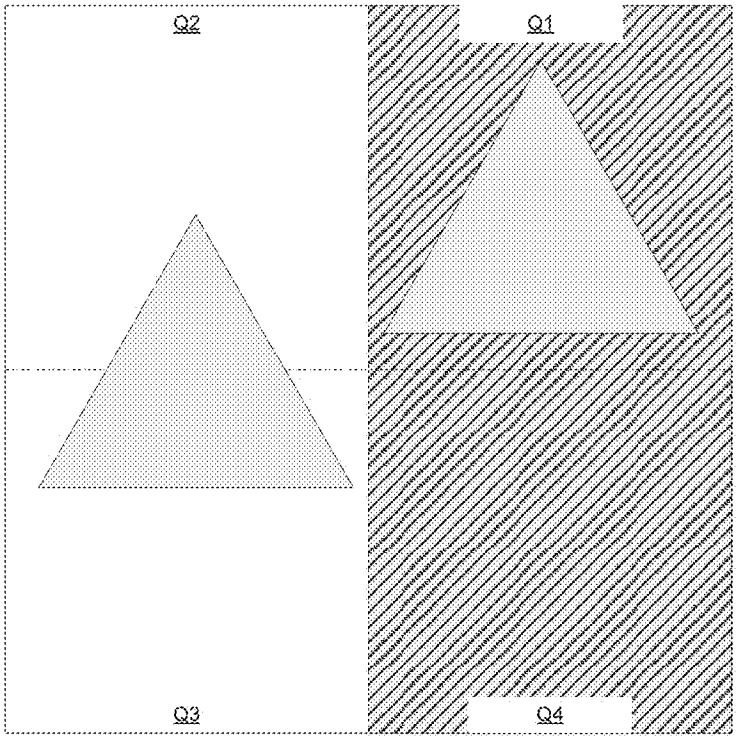
FIG. 2*a* depicts a diagram of a first exemplary frame with partial refresh, in accordance with various embodiments of the present invention.

FIGS. 2*a* and 2*b* depict exemplary frames that illustrate partial refresh, in accordance with various embodiments of the present invention. FIG. 2*a* depicts an exemplary previous frame 200*a* whereas FIG. 2*b* depicts an exemplary current frame 200*b*. As depicted in FIGS. 2*a* and 2*b*, where a portion of consecutive frames change (e.g., Q1), between consecutive frames, the updated portion is detected (either by a processor in a computing device or in a memory device of a display panel) and the pixels comprising the updated portion are refreshed (indicated by the diagonal lines) to display the new data. According to one or more embodiments, partial refresh may also be performed for portions that do not contain updated data, but approach, meet, or exceed their maximum hold time since the last refresh (e.g., timed out). As depicted in FIGS. 2*a* and 2*b*, Q4 may also be refreshed when the pixels in Q4 approach, meet, or exceed the maximum hold time set in the EDID of the display panel, or when the pixels are calculated to fade before the next refresh cycle.

Figure 3:
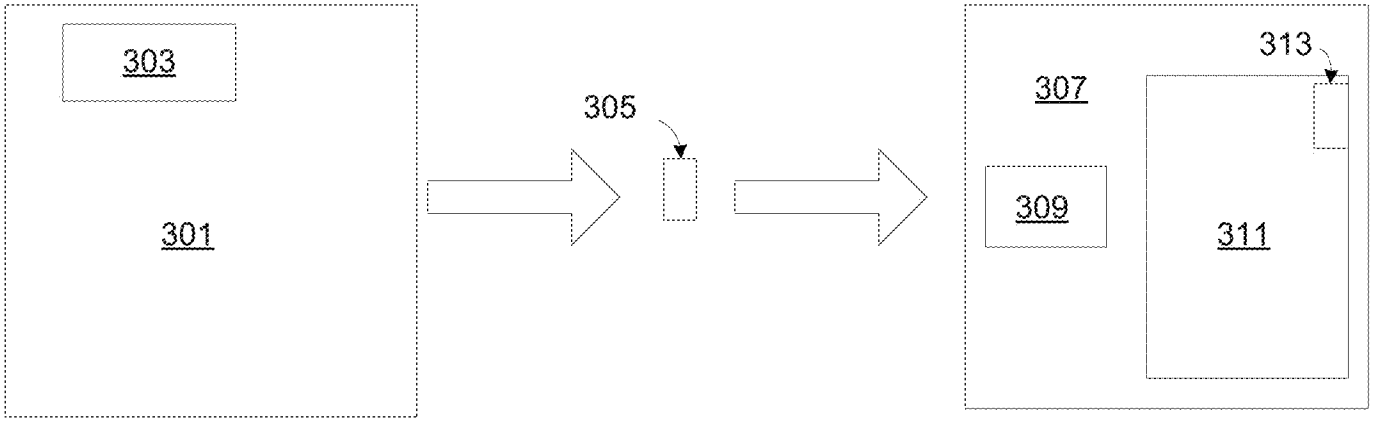
FIG. 3 is a diagram depicting an operation of a computing device during a partial frame update, in accordance with various embodiments of the present invention.

FIG. 3 is a diagram 300 depicting an operation of a computing device rather than a display panel during a partial frame update, in accordance with various embodiments of the present invention. As depicted in FIG. 3, a processor 301 (such as a GPU, CPU, AP, etc.) receives instructions to generate graphical data in a instruction queue (303). In one or more embodiments, the processor compares the instructions to generate a current frame of graphical data with the instructions to generate a previous frame of graphical data to determine an updated portion of the current frame. In one or more embodiments, only the updated portion 305 is generated in the processor for the current frame and transmitted to an attached (or communicatively coupled) display panel 307.

The updated portion 305 may be received in the memory 309 (e.g., GRAM) of the display panel. The pixels 313 of the display screen 311 corresponding to the updated portion 305 are then refreshed during the next refresh cycle. According to one or more embodiments, for any pixels wherein the duration since the last refresh time exceeds the maximum hold time—as specified by the EDID for the display panel—are also refreshed during the next refresh cycle. All other pixels are unmodified. According to one or more embodiments, the timing controller of the display panel 307 that is referenced to identify and enumerate the pixels to be refreshed during the next refresh cycle may enter a low power state immediately after the determination for each refresh cycle, and until the next refresh cycle. As such, since the number of pixels being refreshed will be typically fewer than traditional full-refresh panels, the timing controller is able to consume less power during each refresh cycle relative to conventional implementations.

Figure 4:
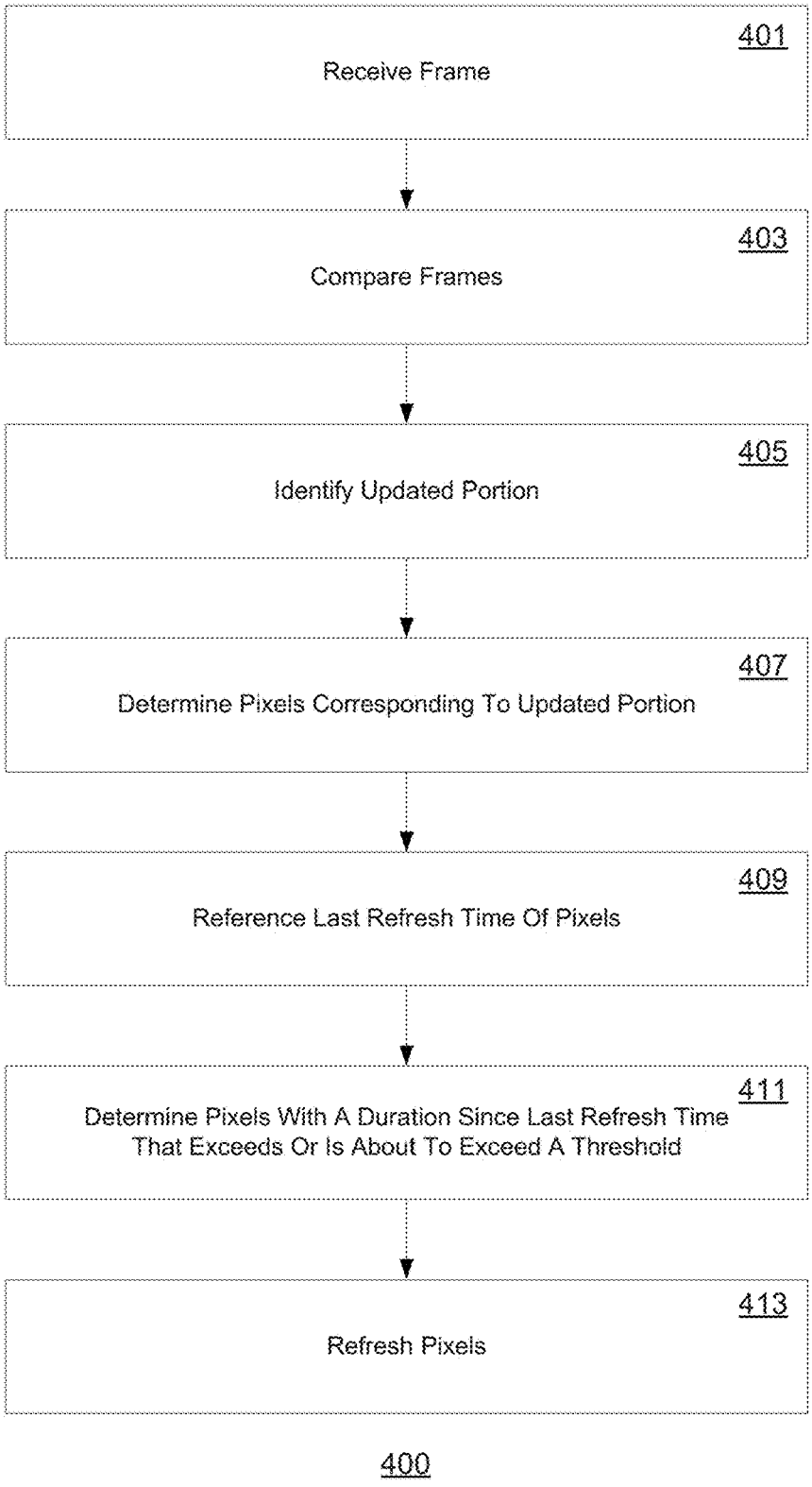
FIG. 4 depicts a flowchart of an exemplary computer-controlled process for performing partial frame updating in a display panel, in accordance with various aspects of the present invention.

FIG. 4 is a flowchart 400 of an exemplary process for performing partial updating in a display panel. Steps 401 to 413 describe the steps comprising the process depicted in the flowchart 400 of FIG. 4. As depicted in FIG. 4, a composed frame is received in step 401. In one or more embodiments, the composed frame may be received in the memory (e.g., GRAM) of the display panel, and may be generated by an application executing in a computing device; and produced in a processor in the computing device, such as a graphics processing unit (GPU), application processor (AP), central processing unit (CPU), or any other microprocessor configured to produce graphical content.

At step 403, the composed frame received in step 401 is compared to the immediate previous frame stored in the GRAM of the display panel. Any modification(s) between the current and previous frames are identified as updated portions in step 405. At step 407, the pixels in the display panel that correspond to the updated portion of the frame are identified. In one or more embodiments, each frame of graphical data is addressed to conform to the size of the pixel array in the display panel, and identification of the pixels in the display panel corresponding to the updated portion may be performed simply by referencing the address location of the updated portion in the display panel.

In one or more embodiments, the pixels in the display panel have a maximum duration of time after which the light emitted by the pixel fades and the pixel needs to be refreshed. This duration (i.e., the maximum hold time) for the pixels may be specified in the display panel's EDID, and may be specified by the manufacturer. At step 409, the last refresh time is determined for all other pixels in the display panel that were not determined at step 407 to be among the pixels corresponding to the updated portion. At step 411, pixels with last refresh times are scanned to determine the last refresh time last refreshed past the maximum hold time. In one or more embodiments, step 411 may be performed by referencing a timing controller (TCON) of the display panel to determine the last refresh times for each of the remaining pixels. In still further embodiments, when the duration since the last refresh time for a pixel approaches the maximum hold time (e.g., meets or exceeds a threshold close to the maximum hold time), the pixel may be marked to be refreshed. According to still further embodiments, the threshold may be set to include pixels with a duration since a last refresh that approach the maximum hold that do not need to be refreshed for the current refresh cycle, but will fade and/or otherwise need to be refreshed by the next refresh cycle.

Finally, at step 413, the pixels corresponding to the updated portion of the frame determined in step 407, and the pixels determined at step 411 to have a last refresh time that meets or exceeds a threshold based on the maximum hold time are refreshed by the display panel. The remaining pixels are maintained without modification, until at least the next refresh cycle.

Figure 5:
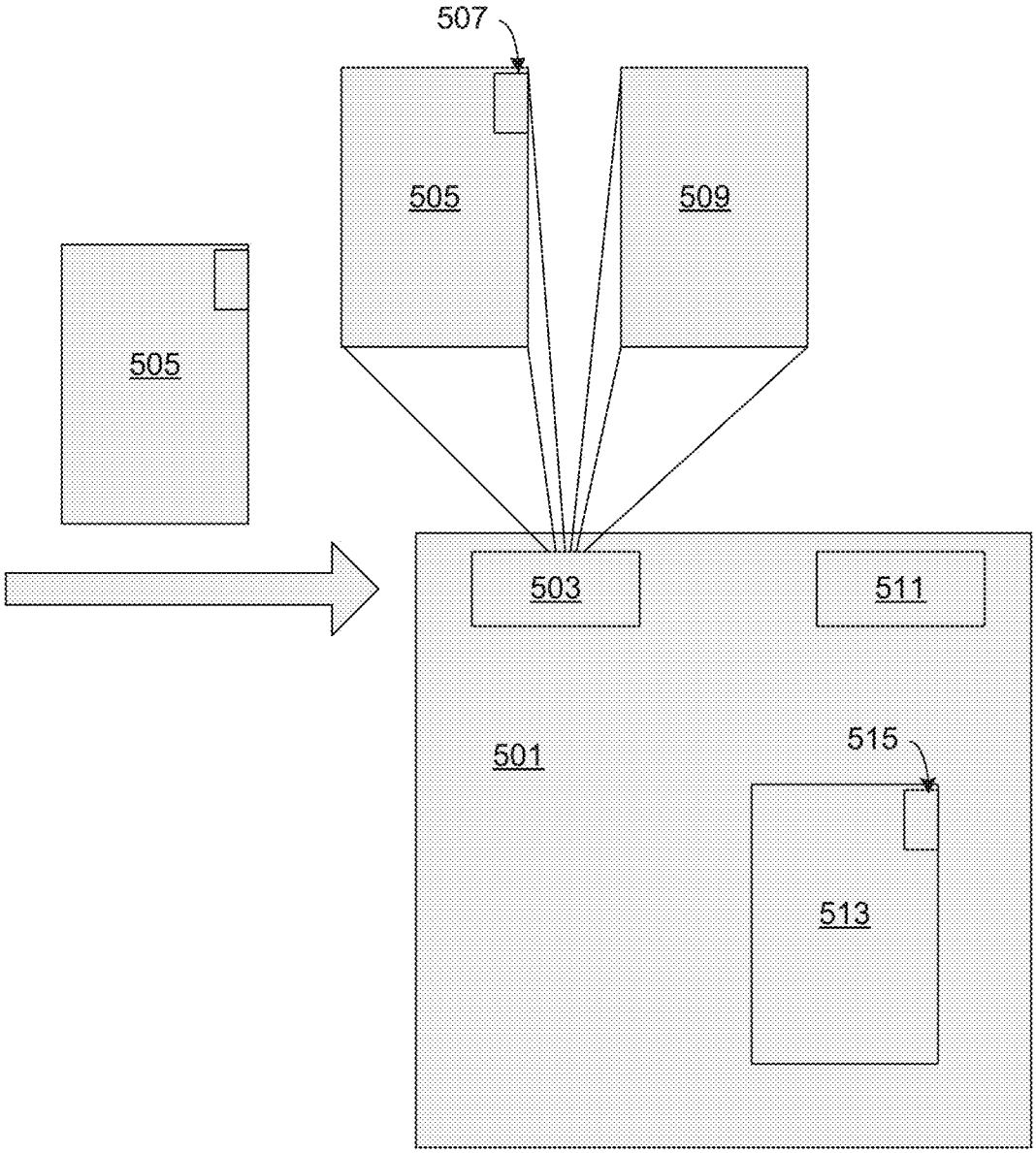
FIG. 5 is a diagram that depicts an operation of a display panel during a partial frame update, in accordance with embodiments of the present invention.

FIG. 5 is a diagram 500 depicting an operation of a display panel during a partial frame update, in accordance with various embodiments of the present invention. As depicted in FIG. 5, a display panel 501 receives a composed frame 505 of graphical data. In one or more embodiments, the composed frame of graphical data may be received in the memory 503 (such as GRAM) of the display panel 501. The composed frame 505 may be generated by a processor in an attached or communicatively coupled computing device, according to instructions from one or more applications executing on the computing device, for example.

The composed frame 505 received in the memory 503 (e.g., GRAM) of the display panel is then compared to a previously generated frame 509 stored in the GRAM. Any inconsistencies between the current 505 and previously generated 509 frames represent updates 507 to the frame. A timing controller 511 in the display device determines the pixels 515 of the display screen 513 that correspond to the updated portion 507, as well as any other pixels with a duration since a last refresh time that meets or exceeds the maximum hold time. Once the pixels are determined, the timing controller 511 immediately enters a low power state until the next refresh cycle, and the pixels identified by the timing controller are refreshed.

Exemplary Computing System

Figure 6:
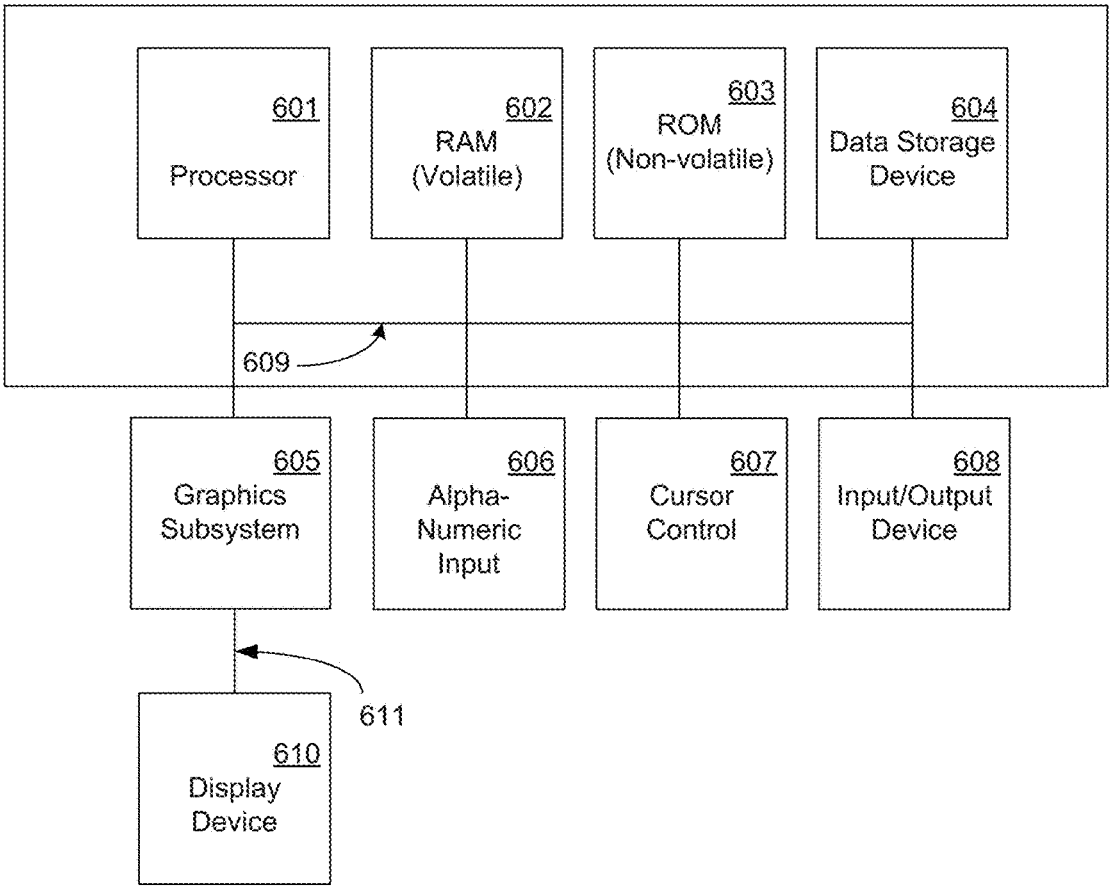
FIG. 6 is an exemplary computing system upon which embodiments of the present invention may be implemented.

As presented in FIG. 6, an exemplary computer system 600 upon which embodiments of the present invention may be implemented (such as the processes 300 and 400 described above) includes a general-purpose computing system environment. In its most basic configuration, computing system 600 typically includes at least one processing unit 601 and memory, and an address/data bus 609 (or other interface) for communicating information. Depending on the exact configuration and type of computing system environment, memory may be volatile (such as RAM 602), nonvolatile (such as ROM 603, flash memory, etc.) or some combination of the two.

Computer system 600 may also comprise an optional graphics subsystem 605 for presenting information to the computer user, e.g., by displaying information on an attached display device 610. In one embodiment, the processing of one or more tasks (e.g., commands and instructions) of an application executing in computer system 600 may be performed, in whole or in part, by graphics subsystem 605 in conjunction with the processor 601 and memory 602, with the resultant graphical output (as a sequence of frames) being displayed in display device 610. In one or more embodiments, only the specifically updated portions between frames may be refreshed (drawn) in the display device 610 between frames, as well as any other pixels that have faded over time, with the remaining pixels being unchanged (corresponding to an absence of changes between frames).

Additionally, computing system 600 may also have additional features/functionality. For example, computing system 600 may also include additional storage (removable and/or non-removable) including, but not limited to, magnetic or optical disks or tape. Such additional storage is illustrated in FIG. 6 by data storage device 607. Computer storage media includes volatile and nonvolatile, removable and non-removable media implemented in any method or technology for storage of information such as computer readable instructions, data structures, program modules or other data. RAM 602, ROM 603, and data storage device 607 are all examples of computer storage media.

Computer system 600 also comprises an optional alphanumeric input device 606, an optional cursor control or directing device 607, and one or more signal communication interfaces (input/output devices, e.g., a network interface card) 609. Optional alphanumeric input device 606 can communicate information and command selections to central processor 601. Optional cursor control or directing device 607 is coupled to bus 609 for communicating user input information and command selections to central processor 601. Signal communication interface (input/output device) 609, also coupled to bus 609, can be a serial port. Communication interface 609 may also include wireless communication mechanisms. Using communication interface 609, computer system 600 can be communicatively coupled to other computer systems over a communication network such as the Internet or an intranet (e.g., a local area network), or can receive data (e.g., a digital television signal).

Embodiments described herein provide a new approach for performing partial updating in a display panel. Advantages of the invention described herein provide for lower power consumption in mobile devices with limited power supplies, resulting in longer operation and longer durations between recharges.

In the foregoing specification, embodiments have been described with reference to numerous specific details that may vary from implementation to implementation. Thus, the sole and exclusive indicator of what is the invention, and is intended by the applicant to be the invention, is the set of claims that issue from this application, in the specific form in which such claims issue, including any subsequent correction. Hence, no limitation, element, property, feature, advantage, or attribute that is not expressly recited in a claim should limit the scope of such claim in any way. Accordingly, the specification and drawings are to be regarded in an illustrative rather than a restrictive sense.

What is claimed is:

1. A method for performing partial frame updating, the method comprising:

receiving instructions to generate a current frame of graphical data in a processor of a computing device;

comparing the instructions to generate the current frame of graphical data to instructions to generate a previously generated frame of graphical data to determine an updated portion of graphical data;

generating the updated portion of graphical data;

sending the updated portion to a self-refreshing display panel communicatively coupled to the computing device;

identifying a first plurality of pixels in the display panel corresponding to the updated portion;

determining a second plurality of pixels in the display panel to be refreshed based on a threshold; and refreshing only the first and second pluralities of pixels in the self-refreshing display panel for a refresh period of the display panel.

2. The method according to claim 1, wherein the current and previously generated frames of graphical data are generated by a graphics processing unit (GPU) comprised in the computing device.

3. The method according to claim 2, wherein comparing the current and previously generated frames of graphical data comprises comparing instructions to generate graphical data corresponding to the current and previously generated frames of graphical data in the GPU.

4. The method according to claim 1, wherein the sending the updated portion to a self-refreshing display panel comprises sending the updated portion to a Graphic Random Access Memory (G-RAM) comprised in the display panel.

5. The method according to claim 1, wherein the previously generated frame of graphical data comprises the most recent frame of graphical data preceding the current frame of graphical data.

6. The method according to claim 1, wherein the threshold corresponds to a maximum hold time for a pixel.

7. The method according to claim 6, wherein the maximum hold time for a pixel is provided by an extended display identification data (EDID) of the display panel.

8. The method according to claim 1, wherein the display panel comprises a timing controller, the timing controller being configured to perform at least one of: the determining, and the refreshing.

9. A method for performing partial frame updates in a self-refreshing display panel, the method comprising:

receiving, in a memory of a self-refreshing display panel, a composed frame of graphical data;

comparing the composed frame of graphical data to a previous frame of graphical data in the memory;

identifying a portion of the composed frame of graphical data comprising an update based on a comparison between instructions to generate the composed frame of graphical data and instructions to generate the previous frame of graphical data;

determining a first plurality of pixels in the self-refreshing display panel corresponding to the portion of the composed frame comprising an update;

determining a second plurality of pixels to be refreshed based on a threshold; and refreshing only the first and second plurality of pixels in the display panel for a refresh period of the display panel.

10. The method according to claim 9, wherein the memory of the self-refreshing display panel comprises a Graphical Random Access Memory (G-RAM).

11. The method according to claim 9, wherein the composed frame is generated in a graphics processing unit (GPU) of a computing device communicatively coupled to the display panel.

12. The method according to claim 9, wherein the threshold corresponds to a maximum hold time for a pixel.

13. The method according to claim 12, wherein the maximum hold time for a pixel is provided by an extended display identification data (EDID) of the display panel.

14. The method according to claim 9, wherein the display panel comprises a timing controller, further wherein at least one of the determining and the refreshing is performed with the timing controller.

15. A system for performing partial updates of a self-refreshing display panel, the system comprising:

a computing system;

a processor comprised in the computing system, the processor being configured to generate graphical output comprising a plurality of frames; and a self-refreshing display panel communicatively coupled to the computing system, the self-refreshing display panel comprising a plurality of pixels and configured to receive and display the graphical output from the processor, wherein, for a refresh period of the self-refreshing display panel, instructions to generate a current frame of the plurality of frames are compared to instructions to generate a previous frame of the plurality of frames to determine an updated portion of graphical data, further wherein, a first portion of pixels of the plurality of pixels corresponding to the updated portion is determined based on the compared instructions, a second portion of pixels to be refreshed is determined based on a threshold, and only the first and second portions of pixels are refreshed for the refresh period of the self-refreshing display panel.

16. The system according to claim 15, wherein the self-refreshing display panel comprises an EDID, the EDID specifying a maximum hold time for a pixel of the plurality of panels.

17. The system according to claim 16, wherein the self-refreshing display panel comprises a timing controller configured to determine the duration since a last refresh for the plurality of pixels.

18. The system according to claim 17, wherein the timing controller is further configured to determine the second portion of pixels from the plurality of pixels having a duration since a last refresh that meets or exceeds the maximum hold time and to mark the second portion of pixels to be refreshed by the display panel.

19. The system according to claim 17, wherein the threshold corresponds to a maximum hold time for a pixel.

20. The system according to claim 18, wherein the timing controller enters a low power state immediately after the first and second portions of pixels are refreshed.

21. The system according to claim 15, wherein the current frame and the previous frame are stored in a memory device.

22. The system according to claim 21, wherein the processor comprises a graphics processing unit (GPU) and the memory device comprises a cache in the GPU.

23. The system according to claim 21, wherein the memory device comprises a graphical random access memory device comprised in the self-refreshing display panel.

* * * * *